US005126629A

United States Patent [19]

Chopy

[11] Patent Number: 5,126,629

[45] Date of Patent: Jun. 30, 1992

[54] SEGMENTED PHOTOMULTIPLIER TUBE WITH HIGH COLLECTION EFFICIENCY AND LIMITED CROSSTALK

[75] Inventor: Hervé Chopy, Mansac, France

[73] Assignee: U.S. Philips Corp., New York, N.Y.

[21] Appl. No.: 610,602

[22] Filed: Nov. 8, 1990

[30] Foreign Application Priority Data

Nov. 14, 1989 [FR] France ..... 89 14902

[51] Int. Cl.[5] ..... H01J 43/20

[52] U.S. Cl. ..... 313/533; 313/534

[58] Field of Search ..... 313/103 CM, 105 CM, 313/531, 533, 534

[56] References Cited

U.S. PATENT DOCUMENTS

| | | | |
|---|---|---|---|
| 2,728,014 | 12/1955 | Stouenheimer et al. | 313/534 |
| 2,945,144 | 7/1960 | Schmidt et al. | 313/533 |
| 4,649,314 | 3/1987 | Eschard | 313/103 CM |
| 4,731,559 | 3/1988 | Eschard | 313/103 CM |
| 4,816,718 | 3/1989 | Lavoute | 313/534 |
| 4,980,604 | 12/1990 | L'hermite | 313/533 |

*Primary Examiner*—Palmer C. DeMeo
*Assistant Examiner*—Diab Hamadi
*Attorney, Agent, or Firm*—William L. Botjer

[57] ABSTRACT

Photomultiplier tube (10) segmented into a plurality of elementary photomultipliers (11), comprising a photocathode (12), a plurality of elementary electron multipliers (13) of the "apertured sheet" type, and a plurality of focusing electrodes (14) providing the convergence of the photoelectrons emitted by the photocathode (12) towards the elementary multiplier (13). In accordance with the invention, the homologous sheets (15) of the elementary multipliers are realised on one single segmented conductor wafer (16) having a neutral zone (17) separating the active apertured zones (18) constituting the different multipliers (13). The said focusing electrodes (14) can be made from one single conductor sheet (19) in which feedthrough apertures (20) are punched through which the photoelectrons are passed towards the elementary multipliers (13).

3 Claims, 2 Drawing Sheets

SEGMENTED PHOTOMULTIPLIER TUBE WITH HIGH COLLECTION EFFICIENCY AND LIMITED CROSSTALK

BACKGROUND OF THE INVENTION

The present invention relates to a photomultiplier tube segmented into a plurality of elementary photomultipliers, comprising a photocathode, a plurality of elementary electron multipliers of the "apertured sheet" type, and a plurality of focusing electrodes providing the convergence of the photoelectrons emitted by the photocathode towards the elementary multipliers.

The invention is particularly suitable for use in the field of high energy physics, and, more specifically, in the field of the detection by photoelectric effects of elementary particles so as to determine, for example, the trajectory. To this effect, it is necessary to provide detection arrangements comprising a large number of separate photomultipliers elements but which are joined to the best possible extent so as to limit the loss of useful surfaces of these arrangements. A solution of this general technical problem which at the same time has the advantage that it reduces the cost of the said detection arrangements, is obtained by dividing a photomultiplier tube into a plurality of elementary photomultipliers. The European Patent Application no. 0 264 992, which corresponds to U.S. Pat. No. 4,816,718, describes a segmented photomultiplier tube of a type as defined in the opening paragraph, in which the elementary multipliers are obtained by partitioning a single "apertured sheet" multiplier, the input space of which situated between the photocathode and the electron multiplier is also partitioned, in such a manner that it is impervious to the electrons emitted by the photocathode, into a plurality of elementary input spaces. This partitioning of the input space base for its effect that crosstalk of photoelectrons which might occur between the different parts is prevented because of the fact that the distance between the photocathode and the multiplier must be relatively large to enable antimony generators, for example, to be positioned sufficiently remote from the input window of the tube for applying during the manufacture of the photocathode, an antimony layer which is as uniform as possible and, also, that the focusing electrodes are raised to a a high electric potential, of the order of the potential of the first sheet of the electron multiplier.

Furthermore, it should be noted that the partitioned multiplier of the prior-art segmented photomultiplier tube is not free from crosstalk. When, for example, the European Patent Application no. 0 350 111 is examined, which describers a "sheet" multiplier of the same type as that used in the prior-art segment tube, it will be seen that the partitioning is made between the extracting and multiplying half-dynodes of the same dynodes of the same dynode with the aid of a brace which is impervious to electrons. In contrast thereto, the space between a multiplying half-dynode and the extracting half-dynode of the subsequent dynode is free, so that electrons which are elastically back scattered to the surface of the said extracting half-dynode near the boundary between two elementary multipliers can pass from an elementary multiplier to the adjacent elementary multiplier to be multiplied there again and, thus, cause crosstalk.

SUMMARY OF THE INVENTION

Therefore, the technical problem to be resolved by the object of the present invention is to provide a segmented photomultiplier tube as defined in the opening paragraph, by means of which any crosstalk will be prevented in the region of the elementary multipliers, and whose input stage will be of a simpler structure whilst still ensuring a very good electronic collection and a minimal cross talk of the photoelectrons.

In the present invention, the solution of the technical problem is achieved, in that the homologous sheets of the elementary multipliers are realized on one single segmented conductor wafer having a neutral zone separating apertured active zones constituting the different multipliers.

Thus, the fact that the active zones of the sheets are separated by a neutral zone having a certain width prevents the back scattered elastic electrons from passing through the said neutral zone to pass from one secondary multiplier to another, as this would mean that the said electrons can effect several consecutive jumps with elastic back scattering at each jump, which is a possibility which can be fully disregarded. The crosstalk in the region of the elementary multipliers for the tube in accordance with the invention is therefore practically non-existent.

On the other hand, as will be described in greater detail hereinafter, by applying near the photocathode an electric potential to the focusing electrodes, the ideal coupling situation between the photocathode and the elementary multipliers is realized, and consequently a perfect collection efficiency, as, in the space between the photocathode and the elementary multipliers, the accelerating electric field originates in essence from the first sheet of the elementary multipliers. It is thus possible to define without the necessity of material partitioning, but also without crosstalk, elementary photocathodes which are associated with elementary photomultiplier tubes as a conjugated surface on the photocathode of the elementary multipliers through the electronic input optics constituted by each focusing electrode and the first sheet of the corresponding elementary multiplier.

The absence of any material partitioning in the input space of the segmented photomultiplier tube of the invention forms in itself already a significant advantage compared with the prior-art tubes.

Advantageously, the said focusing electrodes are realized from the same conducting sheet in which feed through apertures have been punched, and not in an individual manner as in the known tube, with the much easier manner of constructing the tube this involves.

BRIEF DESCRIPTION OF THE DRAWING

The following description which will be given with reference to the accompanying drawings, by way of non-limitative example, will make the nature of the invention better understood and how it can be realized.

DETAILED DESCRIPTION OF THE PREFERRED EMBODIMENT

Figure 1:
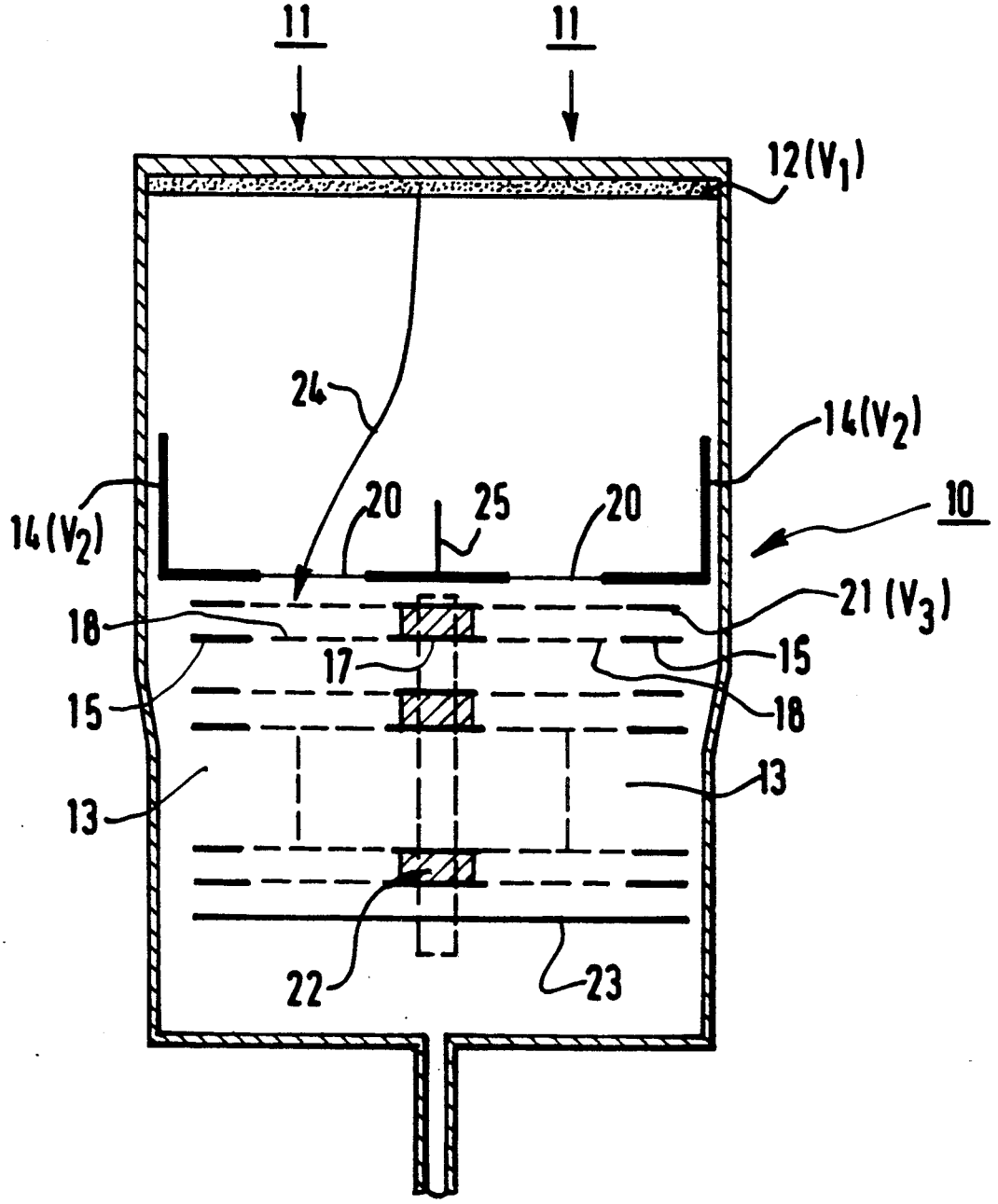
FIG. 1 is across-sectional view of a segmented photomultiplier tube in accordance with the invention.

FIG. 1 is a cross-sectional view of a photomultiplier tube 10 divided into two elementary photomultipliers 11, comprising a photocathode 12, two elementary multipliers 13 of the "apertured sheet" type, and two focusing electrodes 14 which provide the convergence of the photoelectrons emitted by the photocathode 12 towards the said elementary multiples 13.

The photomultiplier tube 10 is terminated by an anode 23, for example a collecting wafer which can be used as an extracting electrode.

The "apertured sheet" elementary multipliers 13 can be similar to those described in the European Patent Application no. 0 131 339, which corresponds to U.S. Pat. No. 4,649,314, or in the European patent Application no. 0 350 111, which corresponds to U.S. Pat. No. 4,980,604.

Figure 2:
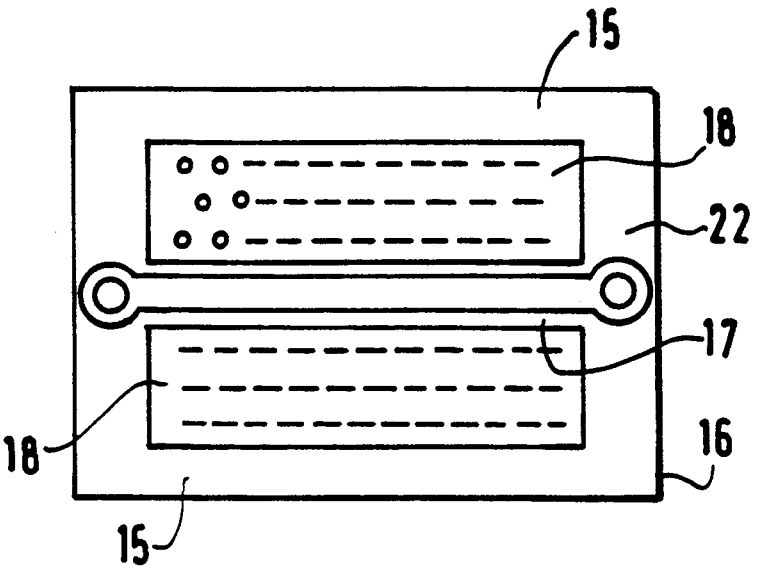
FIG. 2 is a plan view of a segmented conducting wafer of the tube of FIG. 1.

As is shown in FIGS. 1 and 2, the homologous sheets 15 of the elementary multipliers 13 are provided on the same segmented conducting wafer 16 having a neutral zone 17 which separates the apertured active zones 18 constituting the two multipliers 13. The two extracting and multiplying half-dynodes of one and the same dynode are separated in the region of the neutral zone 17 by a conducting partition 22, which is impervious to electrons and prevents crosstalk between the two elementary multipliers 13. Between a multiplicity half-dynode and the subsequent extracting half-dynode, for which such a partitioning is not provided, crosstalk between elementary multipliers is prevented by the presence of the neutral zone 17 which is substantially impenetrable even for electrons which are elastically back scattered onto the extracting half-dynode.

In operation, the photocathode 12 is brought to the electric potential $V_1$, which here will be assumed to be 0 V, the first sheet 21 of the multipliers 13 is at a potential $V_3$ of some hundreds of volts, for example 300 V, while the focusing electrodes 14 are raised to a potential $V_2$ comprised between 0 and 60 V, and generally, less than 20% of the potential $V_3$, for example less than 10% of the potential $V_3$. If the focusing electrodes 14 are at $V_2=0$ V, all the electrons emitted by the photocathode are selectively captured by one or the other of the elementary multipliers 13. The collection is therefore complete and the photocathode-to-elementary multipliers coupling is such that the photocathode 12 is perfectly divided in an immaterial manner into two half-photocathodes which are associated with the respective elementary multipliers, as is shown by the electronic path 24 of FIG. 1.

It will however be noted that with equal potentials $V_1$ and $V_2$, the time response of the tube is not very good, since the transit time of the photoelectrons can vary significantly as a function of the location of the photocathode 12 by which they are emitted. To obviate this disadvantage, also the focusing electrodes 14 are brought to a potential $V_2$ of some dozens of volts, 50 V or 25 V, for example, which improves the response time of the photoelectrons emitted at the periphery of the photocathode without substantially degrading the collection efficiency.

A slight crosstalk of optical origin (reflection) may be produced, which can be obviated by arranging between the focusing electrodes 14 a separating electrode 25, which is at the same potential $V_2$ at the focusing electrodes to reduce light reflections from one path to the other.

Figure 3:
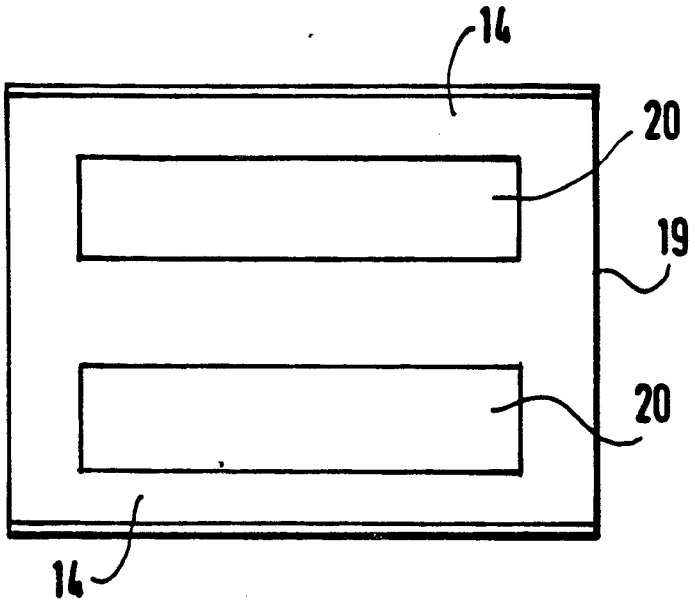
FIG. 3 is a plan view of a conducting sheet forming the focusing electrodes of the tube of FIG. 1.

FIG. 3 shows that the said focusing electrodes are obtained from the same conducting sheet 19, which is optionally folded at its ends, and in which feed through apertures 20 for the photoelectrons towards the elementary multipliers are punched, as is shown in FIG. 1.

The invention has been described for a photomultiplier tube having a square cross-section, divided into 2 elementary photomultipliers. It should however be understood that it also relates to tubes having a different cross-section, for example a circular section, and divided into 3, 4 or more elementary photomultipliers, the segmentation preferably having a symmetry axis corresponding to the longitudinal axis of the tube.

What is claimed is:

1. A photomultiplier comprising a photocathode and an electron multiplier structure and means for focusing the photoelectrons emitted by the photocathode towards the electron multiplier structure, the means for focusing being situated between the photocathode and the electron multiplier structure, said electron multiplier comprising a laminated structure of apertured sheets, said electron multiplier structure being divided into separate elementary electron amplifiers, each apertured sheet being common to a elementary electron multipliers, wherein each common apertured sheet is segmented into separate apertured active zones, each active zone associated with one elementary electron multiplier, the active zones being separated by neutral zones having a width sufficient to prevent back-scattered elastic electrons from passing through said neutral zone from one elementary electron multiplier to an adjacent elementary electron multiplier.

2. A photomultiplier tube as claimed in claim 1, wherein the focusing means comprise focusing electrodes formed from one single conducting sheet into which feed through apertures are punched through which the photoelectrons are transmitted towards the elementary multipliers.

3. A photomultiplier tube as claimed in claim 2, characterized in that it includes at least one separating electrode provided between the focusing electrodes.

* * * * *